United States Patent [19]

Ross

[11] Patent Number: 4,825,489

[45] **Date of Patent: * May 2, 1989**

[54] FITTED SHEET

[76] Inventor: Anthony J. Ross, 526-74th St., Anna Maria Island, Holmes Beach, Fla. 34217

[ * ] Notice: The portion of the term of this patent subsequent to Sep. 6, 2005 has been disclaimed.

[21] Appl. No.: 98,557

[22] Filed: Sep. 21, 1987

[51] Int. Cl.[4] ..... A47G 9/04

[52] U.S. Cl. ..... 5/497; 5/478; 5/502

[58] Field of Search ..... 5/494, 495, 496, 497, 5/498, 491, 482, 500, 502

[56] References Cited

U.S. PATENT DOCUMENTS

| | | | |
|---|---|---|---|
| 1,897,521 | 2/1933 | Lagarde | 5/499 |
| 2,162,755 | 6/1939 | Shauer | 5/497 |
| 2,214,074 | 9/1940 | Clarke | 5/499 |
| 2,516,363 | 7/1950 | Block et al. . | |
| 2,630,588 | 3/1953 | Levin | 5/496 |
| 2,662,234 | 12/1953 | Citron . | |
| 2,695,414 | 11/1954 | Ford et al. | 5/485 |
| 2,696,872 | 12/1954 | Kurland et al. . | |
| 2,791,784 | 5/1957 | Tomsic . | |
| 2,801,427 | 8/1957 | Crocker . | |
| 2,857,643 | 10/1958 | Tomsic . | |
| 2,994,094 | 8/1961 | Hester | 5/497 |
| 3,092,848 | 6/1963 | Gronvold | 5/495 |
| 3,114,156 | 12/1963 | Cobb . | |
| 3,256,038 | 6/1966 | Edelson et al. | 5/497 |
| 3,636,575 | 1/1972 | Smith | 5/499 |
| 3,906,559 | 9/1975 | Bahr . | |
| 4,045,832 | 9/1977 | DiForti et al. | 5/496 |
| 4,144,602 | 3/1979 | Fernandes | 5/496 |
| 4,301,561 | 11/1981 | McLeod . | |
| 4,316,299 | 2/1982 | Friedman | 5/497 |
| 4,461,049 | 7/1984 | Hammond . | |
| 4,549,323 | 10/1985 | Brockhaus | 5/502 |
| 4,606,290 | 8/1986 | Marzotto | 5/498 |
| 4,644,598 | 2/1987 | McGuire et al. | 5/497 |
| 4,651,371 | 3/1987 | Hahn | 5/496 |
| 4,662,013 | 5/1987 | Harriason | 5/497 |
| 4,682,379 | 7/1987 | Dugan . | |

FOREIGN PATENT DOCUMENTS

| | | | |
|---|---|---|---|
| 2853226 | 12/1977 | Fed. Rep. of Germany | 5/497 |
| 1201731 | 8/1970 | United Kingdom | 5/498 |
| 1546904 | 5/1979 | United Kingdom | 5/496 |

*Primary Examiner*—Alexander Grosz
*Assistant Examiner*—Eric K. Nicholson
*Attorney, Agent, or Firm*—Vernon J. Pillote

[57] ABSTRACT

A fitted sheet comprising top, side and end panels for covering the top, sides and ends of a mattress with adjacent ends of the side and end panels connected together to form vertical corners and with the lower portions of the side and end panels extending into underlying relation with the underside of the mattress. Elastic corner bands are attached to each side panel at a location spaced from one end panel and are otherwise attached to the same end panel to extend diagonally therebetween, and a cross band is attached to the lower edges of the side panels at a location adjacent the point of attachment of the corner bands thereto. An embodiment is also disclosed in which a separate mattress pad is removably attached to the underside of the top panel of the fitted sheet.

19 Claims, 2 Drawing Sheets

Fig. 5.
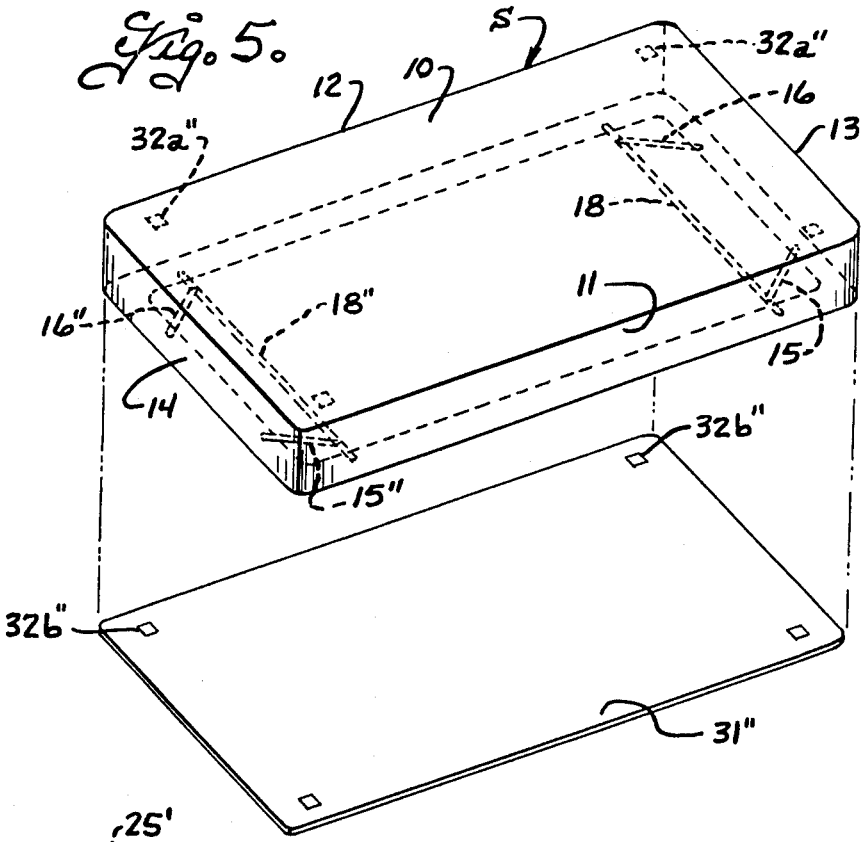
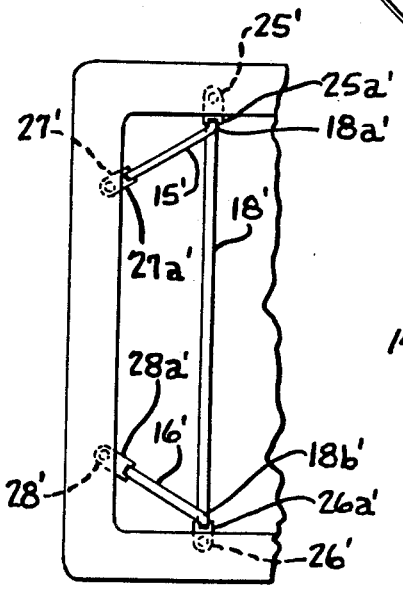
Fig. 4.
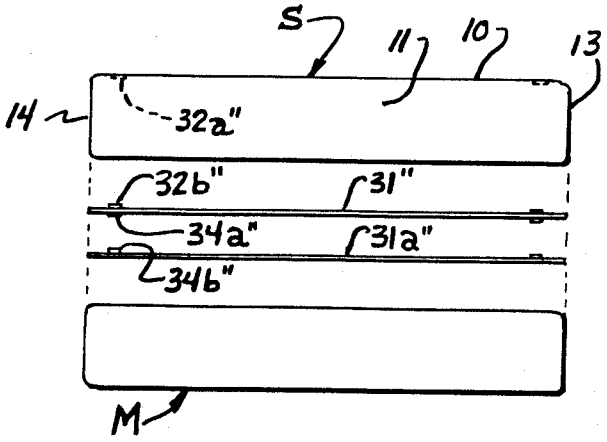
Fig. 6.

FITTED SHEET

CROSS REFERENCE TO RELATED APPLICATIONS

This application is a continuation-in-part of the copending application of Anthony J. Ross, Ser. No. 7/028,797, now U.S. Pat. No. 4,768,252 filed Mar. 23, 1987, for "Fitted Sheet".

BACKGROUND OF THE INVENTION

Fitted sheets for covering a mattress, are well known. Some fitted sheets such as disclosed in U.S. Pat. Nos. 2,662,234, 2,791,784, 2,857,643 and 4,461,049, provide elastic bands that extend diagonally between the corners of the fitted sheet at the underside of the mattress to aid in maintaining the fitted sheet on the mattress. Some others such as disclosed in U.S. Pat. Nos. 2,696,872 and 3,906,559, provide straps that extend crosswise between the side panels of the fitted sheet at the underside of the mattress. U.S. Pat. No. 3,114,156 discloses a fitted sheet having elastic gussets at the corners. U.S. Pat. No. 2,801,427 discloses a fitted mattress cover having some straps located adjacent the corners and which can be tied together to extend diagonally between the corners of the side panels of the mattress cover, and additional straps that can be tied together to extend crosswise of the fitted mattress cover at locations remote from the diagonally extending straps.

SUMMARY OF THE INVENTION

It is an object of the present invention to provide a fitted sheet having an improved arrangement for maintaining the fitted sheet in proper position on the mattress.

It is another object of this invention to provide a fitted sheet in accordance with the foregoing object and which enables the fitted sheet to be easily installed on and removed from the mattress.

Another object of this invention is to provide fitted mattress cover including a fitted sheet in accordance with the foregoing objects and a mattress pad dimensioned to cover the top of the mattress and detachably secured to the underside of the fitted sheet whereby the fitted sheet retains the mattress pad in position when the fitted sheet is installed on the mattress.

Accordingly, the present invention provides a cover for a mattress including fitted sheet having top, side and end panels for covering the top, side and ends of a mattress and connected together to form vertical corners, with the lower edges of the side and end panels spaced from the top panel a distance greater than the height of the mattress so that lower portions of the side and end panels extend below the bottom surface of the mattress. First and second elastic corner bands are attached to at least one end panel and to respective ones of the side panels at locations spaced a distance from the corners between the side and end panels to extend diagonally therebetween, and an elastic cross band is attached to the side panels at locations adjacent the location of attachment of the first and second corner bands to the side panels, to extend between the side panel generally parallel to the lower edge of the adjacent end panel.

According to another aspect of the present invention, the mattress cover includes a fitted sheet as described above, and a mattress pad adapted to underlie the top panel of the fitted sheet, and detachable fastener means on the mattress pad and sheet for removably attaching the mattress pad to the underside of the fitted sheet so that the pad can be applied and removed as a unit with the fitted sheet from the mattress and when applied to the mattress, the fitted sheet retains both the sheet and pad in position on the mattress.

DESCRIPTION OF THE DRAWINGS

FIG. 4 is a fragmentary bottom view of a further modified form of a fitted sheet embodying the present invention;

FIG. 5 is an exploded perspective view of a modified form of covering including a fitted sheet and mattress embodying the present invention; and FIG. 6 is an exploded side view of another form of mattress covering including a fitted sheet and mattress pad means embodying the present invention;

Figure 1:
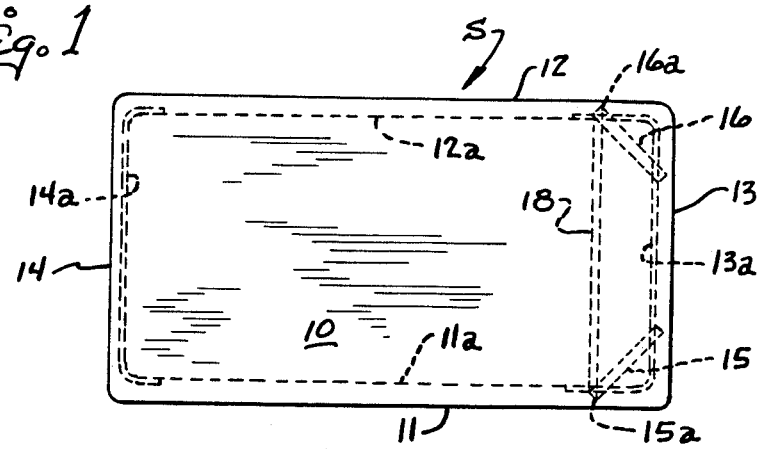
FIG. 1 is a top view of a fitted sheet embodying the present invention shown applied to a mattress.

The reference S has been applied generally to a fitted sheet for use on a rectangular mattress M. The sheet S is formed of a flexible fabric material and includes a top panel 10, first and second side panels 11 and 12, and first and second end panels 13 and 14. The top panel is dimensioned to cover the top of the mattress and the side and end panels are connected together as by stitching to form vertical corners 20 at the corners of the mattress. The side and end panels cover the sides and ends of the mattress M and the side panels 11 and 12 have lower side edges 11*a* and 12*a* respectively and the end panels 13 and 14 have lower side edges 13*a* and 14*a* respectively that are spaced from the top panel a distance greater than the height of the mattress on which the sheet is applied so that lower portions 11*b*–14*b* on the side end panels 11–14 respectively extend below the bottom surface of the mattress and form side and end flaps that underlie the bottom of the mattress.

A retaining means for retaining the fitted sheet in position on the mattress is provided for at least one end of the fitted sheet to be located at the head end of the bed. The retaining means includes first and second elastic corner bands 15 and 16 and a cross band 18. The corner bands 15, 16 have first end portions 15*a*, 16*a* respectively attached to the side panels 11, 12 at a location spaced a distance designated D1 in FIG. 3 from the lower edge 13*a* of one end panel 13, and second end portions 15*b*, 16*b* attached to the same end panel 13 adjacent the lower edge thereof at a location spaced a distance designated D2 in FIG. 3 from the lower edge of the respective one of the side panels 11, 12. The elastic cross band 18 has end portions 18*a* and 18*b* attached to the side panels 11 and 12 adjacent their lower edge and at locations adjacent location of attachment of the respective first and second corner bands, and such that the cross bands extend between the lower edge of the side panels generally parallel to the lower edge of the end panel 13.

The fitted sheet S may be formed of woven textile material as well as non-woven webs. As used herein, the term sheet is intended to cover not only single ply sheets but also multiple ply and padded sheets such as are used in mattress pads. Mattresses generally have a height about seven or eight inches and the side and end panels of the fitted sheet have a height somewhat greater than the height of the mattress so as to provide lower portions or flaps 11b–14b that extend a distance such as one or two inches into underlying relation to the bottom surface of the mattress around the perimeter of the mattress. The distance D1 between the edge 13a of one end panel and the location of attachment of the corner bands 15, 16 to the respective side panels 11 and 12 is preferably made in the range of about six to eight inches and the cross band 18 is attached to the side panels adjacent the location of attachment of the corner bands thereto. The distance D1 is thus preferably in a range that approximates within one or two inches the height of the mattress to which the fitted sheet is applied and the cross band 18 extends generally parallel to the edge 13a of the end panel 13 and is spaced therefrom a distance that approximates within one or two inches the height of the mattress. In the embodiment shown in FIGS. 1–3, the corner bands 15, 16 and cross band 18 are permanently attached to the side and end panels by stitching or fabric adhesives, it being understood that they can also be removably attached by other means such as snaps or clips as shown in FIG. 4. The distance D2 between the lower edge of the side panels 11 and 12 and the point of attachment of the corner bands 15, 16 to the end panel 13 is preferably in a range approximating the range of the distance D1, that is in a range approximating the height of the mattress. The elastic corner bands 15, 16 are arranged so that they are in a partially stretched condition when the fitted sheet is applied to the mattress, so as to draw the lower portions of the sheet into underlying relation with the bottom of the mattress, to aid in maintaining the sheet in a taut condition. The elastic cross band 18 is selected to have a length sufficiently less than the spacing between the edges 11a, 12a of the side panel of the sheet to exert tension therebetween and draw the lower portions of the side panels into underlying relation to the bottom of the mattress. For example, the cross band may have an unstretched length that is 10% to 30% less than the width of the mattress, depending on the tensile strength of the elastic cross band, and the corner bands may similarly have an unstretched length of 10% to 30% less than the diagonal between distances D1 and D2, again depending on the strength of the elastic corner bands. To simplify manufacture, the cross band 18 and corner bands 15, 16 are advantageously formed in a single piece with the corner bands folded at an angle relative to the cross band and secured to the respective side panel. When the cross band 18 and corner bands 15, 16 are provided at only one end of the fitted sheet for use at the head end of the bed, a means such as elastic hem member 22 is advantageously provided along the lower edges of the end panel 14 and at least along portions of the side panels at the other end of the fitted sheet to aid in drawing the lower portions of the side and end panels into underlying relation with the mattress. In the embodiment shown in FIGS. 1–3, an elastic hem member 21 is also provided on the lower edge of the end panel 13 and extends from the end panel 13 and along the side panels at least to the location of attachment of the corner bands and cross band thereto.

FIG. 4 illustrates the cross band and corner bands arranged in the form of a harness that is removably attached to the fitted sheet and the same numerals are used to designate the same parts and like numerals followed by the postscript ′ are used to designate modified parts. As illustrated in FIG. 4, the sheet attaching harness includes an elastic cross band 18′ having first and second end portions 18a′ and 18b′, a first elastic corner band 15′ having one end portion connected to the end portion 18b′ of the cross band and a second elastic corner band 16′ having one end portion connected to the end portion 18b′ of the cross band. First and second fastener means 25′, 26′ are mounted on the first and second end portions of the cross band for removably attaching the first and second end portions of the cross band and one end of the respective first and second corner bands 15′, 16′ to the side panels 11, 12 of the fitted sheet at the locations described in connection with FIGS. 1–3. Third and fourth fastener means 27′, 28′ are respectively mounted on a second end portion of the first and second corner bands 15′, 16′ for removably attaching the second end portions of the elastic corner bands to an end panel of the fitted sheet at the locations described in connection with FIGS. 1–3. The cross band 18′ and corner bands 15′, 16′ are preferably formed of a single piece of elastic ribbon fold along transverse fold lines at 18a and 18b such that the corner bands 15′, 16′ extend laterally at an acute included angle to the cross band. The fasteners 25′–28′ may, for example, be of the type used for attachment to hosiery or type used on suspenders to detachably grip a section of the fabric. As shown, the fasteners are provided with a loop or eyelet at one end for receiving the ribbon and the elastic ribbon is inserted through the eyelets 25a′ and 26a′ and folded over at 18a′ and 18b′ and stitched or otherwise fastened upon itself to secure the cross band and one end of the corner bands to the respective fasteners 25′ and 26′. The free ends of the corner bands 15′ and 16′ are inserted through loops 27a′ and 28a′ on fasteners 27′ and 28′ and then folded over and stitched or otherwise secured upon itself to attach fasteners 27′ and 28′ to the respective corner bands.

While the fitted sheet S is herein shown with a pair of corner bands and a cross band at one end of the fitted sheet, it is to be understood that a similar cross band and corner bands can be provided at the opposite end of the sheet, for example as shown in FIG. 5.

Figure 2:
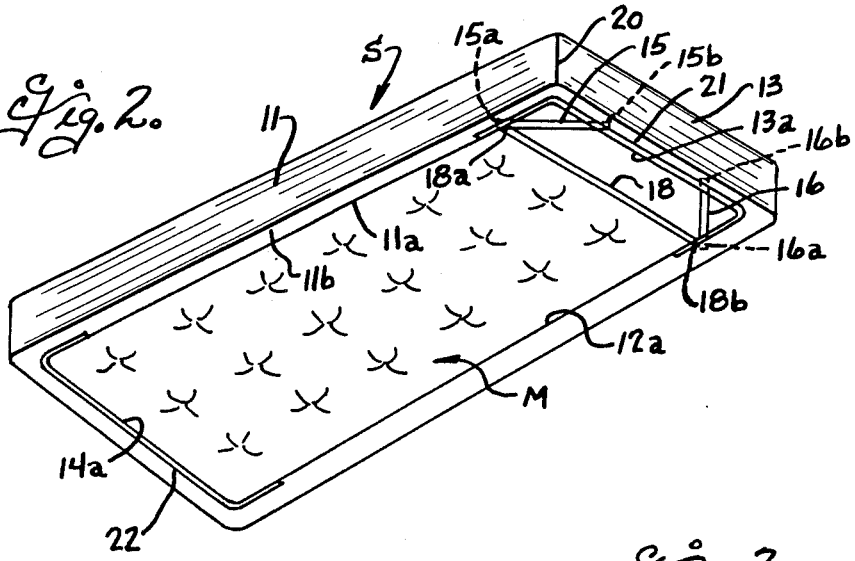
FIG. 2 is a perspective view from the bottom of the mattress showing the fitted sheet of FIG. 1 applied thereto.
Figure 3:
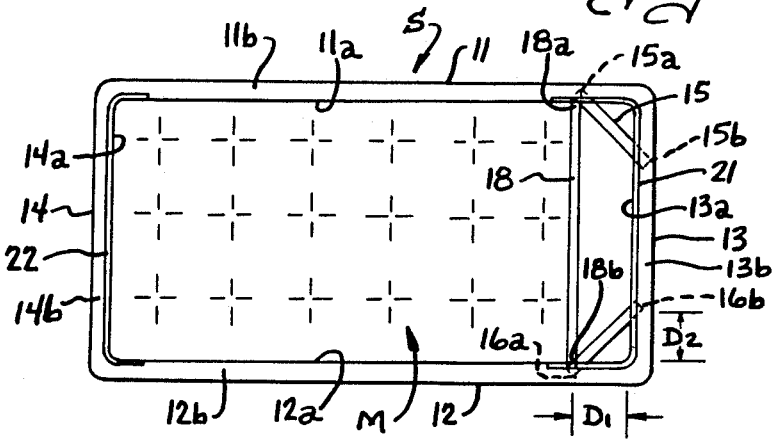
FIG. 3 is a bottom view of the mattress with a fitted sheet of FIG. 1 applied thereto.

In a modified form mattress covering illustrated in FIG. 5, the same numerals are used to designate same parts as described in FIGS. 1–3 with the postscript ″ used to designate modified or added parts. The sheet S has a top panel 10, side panels 11 and 12 and end panels 13, 14. A cross band 18 and corner bands 15, 16 are attached to the side panels 11, 12 and one end panel 13 as previously described. A similar cross band 18″ and corner bands 15″ and 16″ are advantageously provided for the other end of the fitted sheet and attached to the side panels 11, 12 and end panel 14.

In this embodiment, the fitted sheet S is combined with a mattress pad means 31″ in a manner to enable the mattress pad means to be installed and removed as a unit with the sheet S from the mattress. The mattress pad means 31″ has a size at least sufficient to cover the top of the mattress, it being understood that the mattress pad could be extended along the ends and/or sides of the mattress. The mattress pad means 31″ and the underside of the sheet S have a plurality of detachable fastener means having interengaging parts 32a″, 32b″ provided thereon at locations to interengage and enable the mattress pad means to be detachably secured to the underside of the fitted sheet prior to assembly on the mattress. The detachable fastener means 31a″, 31b″ may, for example, comprise snap type fasteners or hook and loop type fasteners such as sold under the trademark "Velcro". The mattress pad means can comprise a pad that is washable and re-usable, or a disposable type mattress pad. Further, the mattress pad can be one-piece pad, with or without a moisture barrier layer as shown in FIG. 5. It is also contemplated that a separable moisture proof sheet 31*a*'' can be provided at the underside of the pad as shown in FIG. 6. Detachable fastener means as indicated at 34*a*'' and 34*b*'' are provided on the underside of the pad 32' and on the top of the moisture proof sheet 31*a*'' to detachably secure the moisture proof sheet 31*a*' to the underside of the pad. The detachable fastener means 34*a*'', 35*b*'' are preferably located adjacent the corners of the pad 31'' and barrier sheet 31*a*'' to detachably secure the barrier sheet 31*a*'' to the pad.

From the foregoing it is thought that the construction and use of the fitted sheet will be readily understood. The corner bands 15, 16 and cross band 18 are attached to the side panels at a location spaced from one end panel a distance approximating the height of the mattress so that the fitted sheet with the corner bands and cross band affixed can be easily slipped over the end of the mattress during installation and removal of the fitted sheet. It has been found that the provision of the corner bands and cross bands that extend between the side panels at the location of attachment of the corner bands thereto, markedly improves retention of the fitted sheet on the mattress. In this regard it will be seen that any forces on the fitted sheet that tend to move the lower portion of either side panel of the fitted sheet out of underlying relation to the mattress, will be transmitted by the attached corner band to the adjacent end panel and also transmitted by the cross band 18 to the opposite side panel. In the arrangements shown in FIGS. 5 and 6, the mattress pad means covers the top of the mattress and is attached to the underside of the fitted sheet, for installation and removal therewith, and the retaining means on the fitted sheet not only retains the fitted sheet in position on the mattress but also retains the underlying pad in position.

The embodiments of the invention in which an exclusive property or privilege is claimed are defined as follows:

1. A covering for a rectangular mattress comprising:

(a) a fitted sheet having top, side and end panels for covering the top, sides and ends respectively of a mattress with adjacent ends of the side and end panels connected together to form vertical corners, the side and end panels each having lower edges extending lengthwise thereof and spaced from the top panel, (b) elastic first and second corner bands each having one end portion attached to a respective one of the side panels adjacent the lower edges thereof at locations thereon spaced a first preselected distance from the lower edge of one end panel, the first and second corner bands each having a second end portion attached to said one end panel adjacent the lower edge thereof at locations thereon each spaced a second preselected distance from the lower edge of a respective one of the side panels, the first and second elastic corner bands extending diagonally between the lower edges of said one end panel and the lower edge of the respective side panel and having an unstretched length such that the corner bands are stretched when the sheet is applied to a mattress, (c) an elastic cross band having end portions attached to opposite side panels at the locations of attachment of the first and second corner bands to the side panels, said cross band extending between the lower edges of the side panels generally parallel to the lower edge of said one end panel and having an unstretched length such that the cross band is stretched when the sheet is applied to a mattress.

2. A covering for a mattress according to claim 1 wherein said first preselected distance is in a range of about 6 to 8 inches.

3. A covering for a mattress according to claim 1 wherein first and second preselected distances are each in a range of about 6 to 8 inches.

4. A covering for a mattress according to claim 1 wherein said first and second preselected distances are each approximately the same as the height of the mattress to which the sheet is applied.

5. A covering for a mattress according to claim 1 including an elastic member attached in a stretched condition along the lower edge of said one end panel and to at least along the portions of lower edge of said side panels between said one end panel and the location of attachment of the cross band thereto.

6. A covering for a mattress according to claim 1 wherein the cross band and first and second corner bands are formed of a single piece of elastic ribbon folded along first and second transverse fold lines such that the corner bands extend laterally at an acute included angle to the cross band.

7. A covering for a mattress according to claim 1 wherein the cross band and corner bands have means for removably attaching the end portions thereof to the respective side and end panels of the sheet.

8. A covering for a mattress according to claim 1 including third and fourth corner bands attached to a respective one of the side panels adjacent the lower edge thereof at locations thereon spaced said first preselected distance from the lower edge of the other end panel, the third and fourth corner bands each having a second end portion thereof attached to said other end panel at locations thereon spaced said second preselected distance from the lower edge of a respective one of the side panels, the third and fourth elastic corner bands extending diagonally between the lower edge of said other end panel and the lower edge of the respective side panel and having an unstretched length such that the third and fourth corner bands are stretched when the sheet is applied to a mattress, and a second elastic cross band attached to opposite side panels at locations adjacent the locations of attachment of the third and fourth corner bands to the side panels, said second cross band extending between the lower edges of the side panels generally parallel to the lower edge of the other end panel and having an unstretched length such that the second cross band is stretched when the sheet is applied to a mattress.

9. A covering for a mattress according to claim 1 including pad means adapted to underlie at least the top panel of the fitted sheet, and means for removably attaching the pad means to the fitted sheet.

10. A covering for a mattress according to claim 1, including a pad means having a size substantially the same as the top panel of the fitted sheet and adapted to underlie only the top panel of the sheet, and separable fastener means on the pad means and the top panel of the sheet for removably attaching the pad means to the underside of top panel of the fitted sheet.

11. A fitted mattress cover according to claim 10 wherein said interengaging fastener means are located adjacent the corners of the pad means.

12. In a fitted sheet having top, side and end panels for covering the top, sides and ends respectively of a mattress with adjacent ends of the side and end panels connected together to form vertical corners, the side and end panels each having lower edges extending lengthwise thereof and spaced from the top panel, the improvement comprising:

at least one sheet attaching harness including an elastic cross band having first and second end portions, a first elastic corner band having one end portion connected to the first end portion of the cross band and a second elastic corner band having one end portion connected to the second end portion of the cross band, first and second fastener means mounted on the first and second end portions of the cross band for removably attaching the first and second end portions of the cross band and said one end of the respective first and second corner bands to the side panels of the fitted sheet adjacent their lower edges, and third and fourth fastener means respectively mounted on a second end portion of the first and second corner bands for removably attaching the second end portions of the elastic corner bands to one end panel adjacent its lower edge.

13. In a fitted sheet according to claim 12 wherein said first and second corner bands extend from the first and second end portions laterally an acute included angle to cross band.

14. In a fitted sheet according to claim 12 including a second one of said sheet attaching harnesses for attachment to the side panels and the other end panel of the fitted sheet.

15. In a fitted sheet according to claim 13 wherein the cross band and the first and second corner bands are formed of a single piece of elastic ribbon folded along first and second transverse fold lines.

16. In a fitted sheet according to claim 12 including pad means adapted to underlie at least the top panel of the fitted sheet, and means for removably attaching the pad means to the fitted sheet.

17. In a fitted sheet according to claim 12 including a pad means having a size substantially the same as the top panel of the fitted sheet and adapted to underlie only the top panel of the sheet, and separable fastener means on the pad means and the top panel of the sheet for removably attaching the pad means to the underside top panel of the fitted sheet.

18. In a fitted sheet according to claim 17 wherein said separable fastener means are located adjacent the corners of the pad means.

19. In a fitted sheet according to claim 12 wherein said first and second fastener means are adapted to be attached to the side panels at locations spaced from one end panel about 6 to 8 inches and the third and fourth fastener means are adapted for attachment to one end panel at locations spaced about 6 to 8 inches from a respective one of the side panels, and the cross band and corner bands are stretched about 10% to 30% when attached at said locations.

* * * * *